US007717388B2

(12) United States Patent
Rizzo

(10) Patent No.: US 7,717,388 B2
(45) Date of Patent: May 18, 2010

(54) DISPLAY MOUNTING FOR A DECORATIVE OBJECT

(76) Inventor: Tony Rizzo, 22116 Edgewood, St. Clair Shores, MI (US) 48080

( * ) Notice: Subject to any disclaimer, the term of this patent is extended or adjusted under 35 U.S.C. 154(b) by 0 days.

(21) Appl. No.: 12/077,636

(22) Filed: Mar. 20, 2008

(65) Prior Publication Data

US 2009/0236491 A1 Sep. 24, 2009

Related U.S. Application Data

(60) Provisional application No. 60/920,714, filed on Mar. 29, 2007.

(51) Int. Cl.
*A47G 1/10* (2006.01)
*G09F 7/18* (2006.01)

(52) U.S. Cl. ..... 248/316.7; 248/231.81; 40/658; 40/745

(58) Field of Classification Search ..... 248/316.1, 248/154, 316.7, 231.81, 311.2, 229.16, 229.26, 248/309.1, 313, 312.1; 24/3.11, 3.12; 224/197, 224/269, 930; 40/745, 642.02, 652, 658, 40/647, 427

See application file for complete search history.

(56) References Cited

U.S. PATENT DOCUMENTS

| | | | | | |
|---|---|---|---|---|---|
| 3,689,687 | A * | 9/1972 | Bosch | 248/316.7 |
| 4,175,306 | A * | 11/1979 | Bigelow et al. | 24/507 |
| 4,261,121 | A * | 4/1981 | Coon | 40/332 |
| 4,561,301 | A * | 12/1985 | Steele | 73/170.05 |
| 5,033,528 | A * | 7/1991 | Volcani | 160/351 |
| 5,645,254 | A * | 7/1997 | Ng et al. | 248/316.7 |
| 5,853,158 | A * | 12/1998 | Riggle | 248/311.2 |
| 6,425,167 | B1 | 7/2002 | Barbarite | |
| 2004/0093781 | A1 * | 5/2004 | Sievers | 428/11 |
| 2007/0031635 | A1 * | 2/2007 | Shepardson | 428/99 |

OTHER PUBLICATIONS

PCT Search Report.

* cited by examiner

*Primary Examiner*—Amy J Sterling
*Assistant Examiner*—Tan Le
(74) *Attorney, Agent, or Firm*—John R. Benefiel

(57) ABSTRACT

A display mounting for an ornamental object includes a spring clip having an elongated spring attached at one end and the ornamental object is affixed to the opposite end to be readily attachable to the bill of a cap, Christmas branches etc.

4 Claims, 3 Drawing Sheets

DISPLAY MOUNTING FOR A DECORATIVE OBJECT

CROSS REFERENCE TO RELATED APPLICATION

This application claims the benefit of U.S. provisional application Ser. No. 60/920,714 filed on Mar. 29, 2007.

BACKGROUND OF THE INVENTION

This invention concerns decorative objects such as ornaments, sports items, figures, etc. and more particularly display mountings for such items. Conventional display mountings as for Christmas trees are hung using sire hooks, strings, etc. Sports items are typically fixed on a base and in these mountings the decorative item is held in a static position and is not easily relocated to another position or to another supporting structure.

It is an object of the present invention to provide a display mounting for decorative objects which allows motion in a way as to increase its appeal and enable ready relocation of the item.

SUMMARY OF THE INVENTION

The above recited objects and others which will be understood upon a reading of the following specification and claims are achieved by a display mounting in which the object is attached to one end of an elongated spring, such as a tightly wound helical coil spring, and with the other end fixed to a clip conveniently enabling attachment to a support. In particular, the clip can provide for attachment to the bill of a cap, and to mount a sports object bearing a team logo. Movement of the wearer of the cap will induce a "bobble" wobbling motion of the object to increase its visual appeal.

The mounting can be used to attach Christmas ornaments to Christmas tree branches, with the elongated spring element allowing the ornament to project out from the Christmas tree itself to be positioned for more prominent display.

A great variety of objects are suitable for such mounting.

The clip is preferably of a spring type which is configured to allow ready adjustability of the angular position of the spring element and attached object to allow selective positioning of a mounted object in various positions relative the support to which it is attached.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
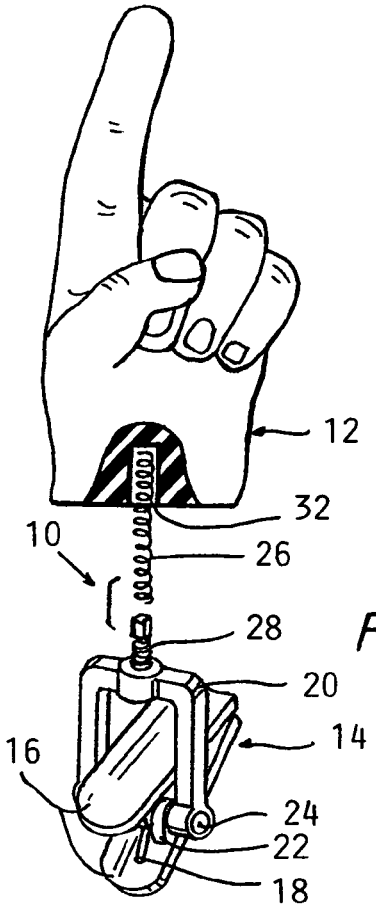
FIG. 1 is a partially exploded pictorial view of a decorative object and a display mounting therefore according to the present invention.

Referring to the drawings and in particular FIG. 1, a mounting 10 for a decorative object 12 according is the present invention includes a pivoted spring clip 14 of a type known in the art, having a pair of opposed clip fingers 16 pivotally mounted and urged together with a wound spring 18 to enable ready attachment to a support.

The pivotal mount includes a U-shaped frame 20 receiving the clip gripper fingers 16 each formed with clevis ears 22 through which a pivot pin 24 passes. The pivot pin 24 also is received in both legs of the frame 20 to thereby pivotally mount the fingers 16 on the frame 20.

This pivotal mount allows ready adjustment of the angle of the frame 20 relative the fingers 16 to orient an elongated spring 26 as desired. Sufficient friction between the devises 22 and the frame 20 is provided to maintain an adjusted position of the frame 20 and gripper fingers 16.

The elongated spring element 26, here shown as a tightly wound helical coil spring, is attached at one end of the frame 20 as by being received over a plug feature 28, to project away from the frame 20.

Figure 2:
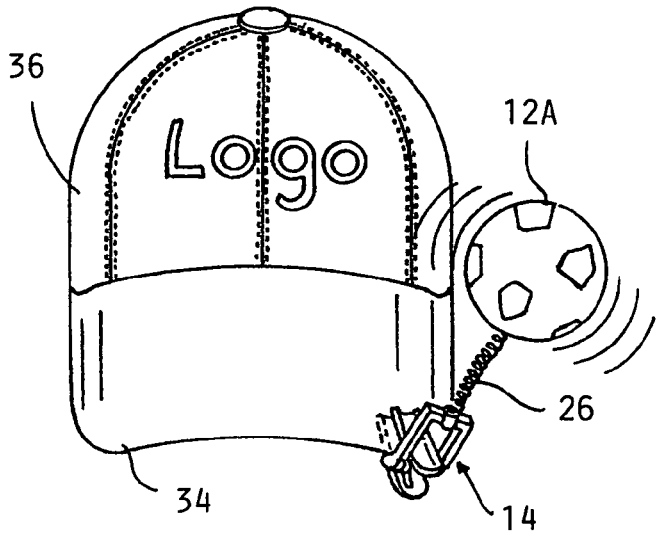
FIG. 2 is a pictorial view of another decorative object attached to the bill of a cap by a display mounting according to the present invention.
Figure 2A:
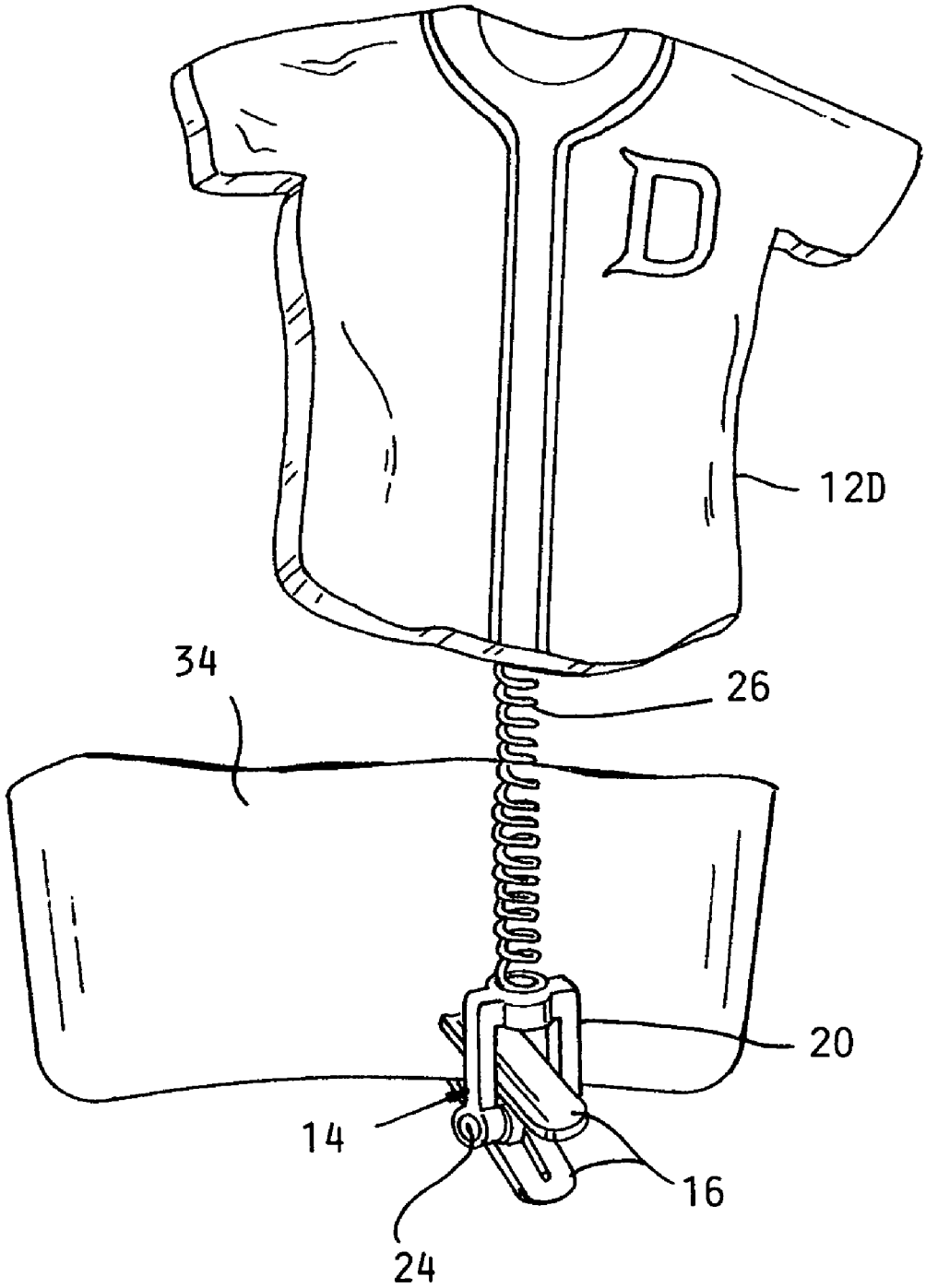
FIG. 2A is a pictorial view of a sports team uniform figure attached to a ball cap brim.
Figure 4:
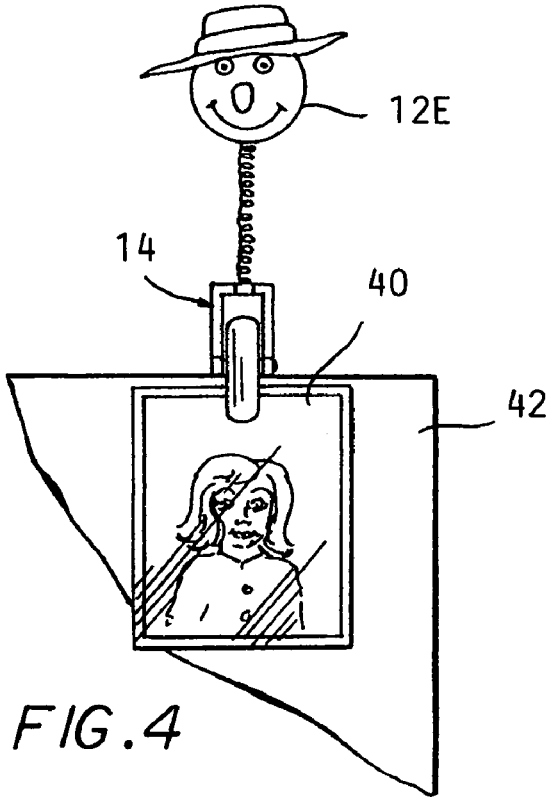
FIG. 4 is a front view of another decorative object attached to a support by a display mounting according to the present invention showing attachment of a photograph as well.

Other attachments can be provided such as by molding in the one end of the elongated spring element 26 (FIG. 2A).

The other end of the elongated spring element 26 has the decorative object 12 attached thereto as by being pressed into a hole 32 at one end.

The spring clip 14 allows a decorative object such as a miniature soccer ball 12A (FIG. 2) to be attached to a variety of supports such as the bill 34 of a cap 36.

FIG. 2A shows a sports team uniform FIG. 12B attached to the bill 34. The spring 26 has one end molded into the spring clip frame 20.

So mounted, slight movements of the wearer causes oscillating motion of the decorative objects 12A or 12B to be induced, creating a visual effect calling attention to the object 12A or 12B in a similar manner to the "bobble head" novelty items currently popular.

The projection of the object 12A from the support towards the viewer also provides a further attention getting effect.

Figure 3:
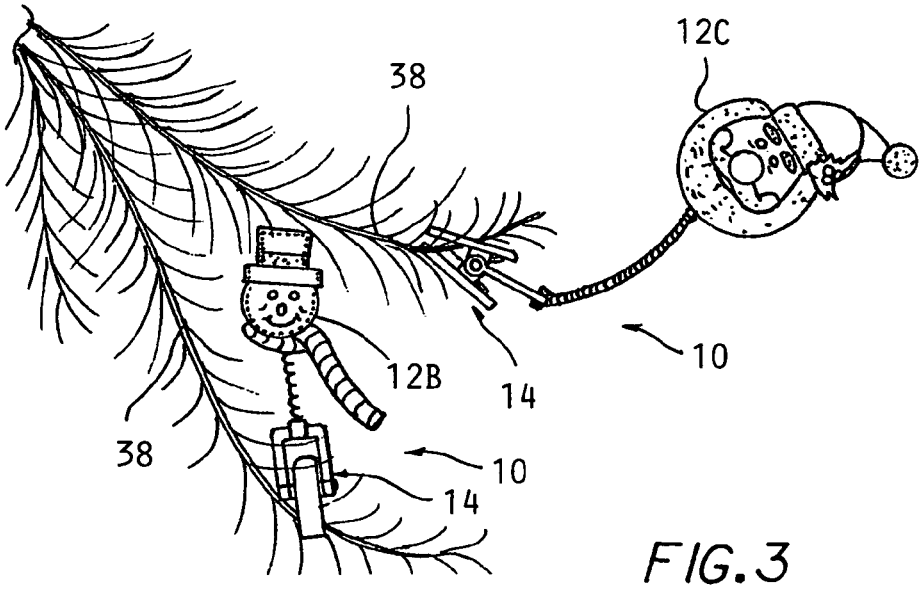
FIG. 3 is a view of a pair of Christmas ornaments attached to branches of a Christmas tree by a display mounting according to the present invention.

This is especially effective for Christmas tree ornaments 12C, 12D (FIG. 3) where the amounts 12B, 12C are held projecting out from tree branches 38 to be more visible.

The spring clip 14 can do double duty by also mounting a photo 40 or other sheet item to a support 42 as well as a decorative object 12E.

Figure 5:
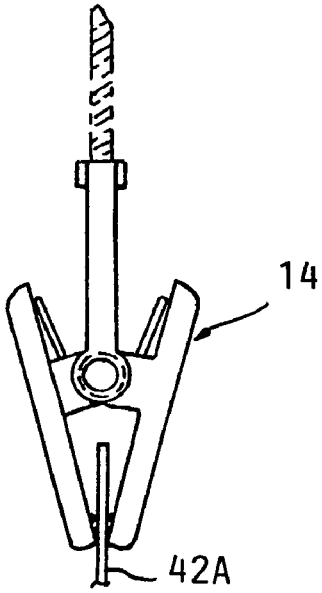
FIG. 5 is an enlarged fragmentary of a pivoted spring clip used in a display mounting according to the present invention and a portion of a support to which it is attached.
Figure 5B:
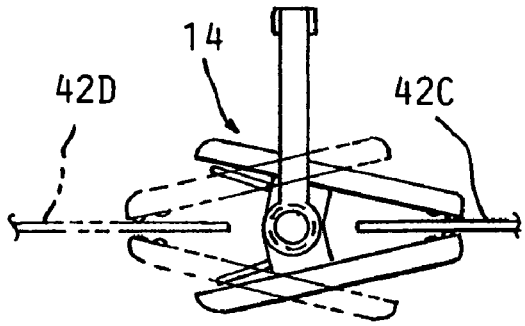
FIG. 5B is a side view of the pivoted clip shown in FIGS. 5 and 5A.
Figure 5A:
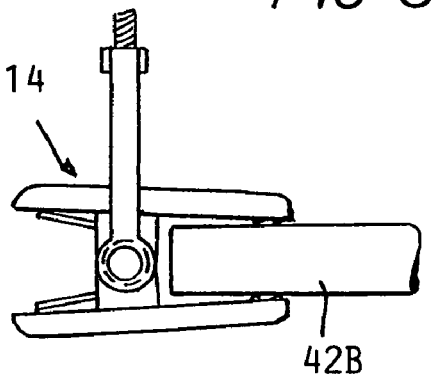
FIG. 5A is a pictorial view of the pivoted clip shown in FIG. 5 and rotated 90° to a horizontal support.

FIGS. 5, 5A, 5B show the capability of angular adjustment of the spring clip 14 for providing various orientations relative a support 42A, B, C, and D.

Accordingly a simple mounting is provided which provides enhancement of the display of an ornamental object.

The invention claimed is:

1. A display mounting in combination with an ornamental object comprising:

a spring clip having a pair of facing opposing finger elements each pivoted at an intermediate location along their length to allow said finger elements to be pivoted relative each other, with a spring urging pivoting of said finger elements so as to bring a tip at one end of each finger element towards each other to grip a support therebetween and allowing pivoting to spread the tips apart against the urging of said spring to release said clip from said support; a U-shaped frame including a pair of legs extending from a joining portion thereof, a pivotal mount for said finger elements extending between said pair of legs with said finger elements disposed thereon so as to enable adjustment of the inclination of said finger elements relative to said joining portion of said frame by pivoting of said finger elements on said frame pivot mount;

an elongated spring element attached at one end to said joining portion of said frame and extending away therefrom; and an ornamental object attached to an opposite end of said spring element whereby the inclination of said spring element relative said support can thereby be varied by pivoting of said finger elements on said frame.

2. The combination according to claim 1 wherein said spring element comprises a tightly wound helical spring.

3. The combination according to claim 1 in further combination with a cap and wherein said support comprises a bill of said cap.

4. A display mounting according to claim 1 in combination with a Christmas tree branch and wherein said ornamental object comprises a Christmas ornament and said support comprise a Christmas tree branch.

* * * * *

UNITED STATES PATENT AND TRADEMARK OFFICE

CERTIFICATE OF CORRECTION

PATENT NO. : 7,717,388 B2
APPLICATION NO. : 12/077636
DATED : May 18, 2010
INVENTOR(S) : Tony Rizzo It is certified that error appears in the above-identified patent and that said Letters Patent is hereby corrected as shown below:

Col. 2, line 27, delete "devises" and insert -- clevises --.

Signed and Sealed this
Fifth Day of April, 2011

David J. Kappos

David J. Kappos
*Director of the United States Patent and Trademark Office*